US006809752B2

(12) United States Patent
Nagamine

(10) Patent No.: US 6,809,752 B2
(45) Date of Patent: Oct. 26, 2004

(54) OPTICAL HEAD AND IMAGE FORMING APPARATUS

(75) Inventor: Masamitsu Nagamine, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/446,072

(22) Filed: May 28, 2003

(65) Prior Publication Data

US 2003/0222968 A1 Dec. 4, 2003

(30) Foreign Application Priority Data

May 28, 2002 (JP) ..... 2002-153273

(51) Int. Cl.[7] ..... B41J 2/45

(52) U.S. Cl. ..... 347/238; 347/241; 347/242; 347/245

(58) Field of Search ..... 347/233, 238, 347/241, 242, 245, 256, 257, 258; 257/99

(56) References Cited

U.S. PATENT DOCUMENTS 5,291,039 A * 3/1994 Ogata et al. ..... 257/99
5,403,102 A * 4/1995 Yokoyama ..... 347/238
6,025,863 A 2/2000 Nakajima et al.
2002/0149664 A1 * 10/2002 Nagamine et al. ..... 347/238

FOREIGN PATENT DOCUMENTS

| | | | | |
|---|---|---|---|---|
| JP | 05-191562 | * | 7/1993 | ..... H04N/1/028 |
| JP | 2002361931 | * | 12/2002 | ..... B41J/2/455 |
| JP | 2003-011413 | * | 1/2003 | ..... B41J/2/455 |
| JP | 2003-011414 | * | 1/2003 | ..... B41J/2/455 |

* cited by examiner

*Primary Examiner*—Huan Tran
(74) *Attorney, Agent, or Firm*—Rabin & Berdo, P.C.

(57) ABSTRACT

An LED head is supplied which is able not only to reduce cost but also to improve disintegration efficiency and assembly efficiency. The LED head comprises a SLA holder with electroconductivity which has a insulating cover and supports a rod lens array with convergency; a substrate which is mounted in the SLA holder and is used for installing a LED array chip; a base with electroconductivity used for fixing the substrate at the SLA holder; and a clamp with electroconductivity which presses and contacts the base, wherein the clamp, while mounted onto the SLA holder, scrapes off contact part of the insulating cover.

42 Claims, 10 Drawing Sheets

OPTICAL HEAD AND IMAGE FORMING APPARATUS

BACKGROUND OF THE INVENTION

1. Field of the Invention

The invention relates to an optical head and an image forming apparatus using the optical head.

2. Related Background Art

In an LED (Light Emitting Diode) printer, that is, electronic photograph printer serving as an image forming apparatus, using an LED head as a writing-in light source, an exposing process is performed. In the exposing process, the light produced by the LED array chip serving as an emitting light section is converged through a rod lens array with convergency, i.e., self focusing lens array (hereinafter: SLA) serving as a light guide section. Then, an electrostatic latent image is formed by exposing the light to a photo conductor drum which is placed at a position with light image-formation and is all charged with electricity.

FIG. 2 is a perspective view showing a conventional LED head; FIG. 3 is a front view showing the conventional LED head; FIG. 4 is a first cross-sectional view showing the conventional LED head; and FIG. 5 is a second cross-sectional view showing the conventional LED.

In FIG. 4 and FIG. 5, 11 is an LED array chip, 12 is a SLA, 13 is a substrate on which LED array chip is installed, 14 is an SLA holder i.e. a holder for holding the SLA 12 and mounting the substrate 13, and 15 is a base for sandwiching the substrate 13 together with the SLA holder 14. The base 15 is formed from metal material and is fixed by frictional force between itself and the SLA holder 14.

The SLA holder 14 serves as a frame of an LED head, and is formed as one body by die-casting which uses metal material, for example, Aluminum, which is soured into a mold. With respect to such an SLA holder 14, because 4 its outer surface is in a natural state, i.e., it is not processed, the outward appearance will be not beautiful; further, because its inter surface needs to inhibit the reflection of the light produced by the LED array chip 11 on itself and to insulate from the substrate 13, in general, the outer surface and the inner surface are painted with a black insulating material.

Because the SLA holder 14 is a metal-made member, as shown by FIGS. 2 and 5, for making it obtain an earth, one end of an earth line 18 is fixed on the SLA holder 14 via a metal-made screw. The other end of the earth line 18 is connected with a FG (frame ground) in the image forming apparatus, which is not shown by the figures. Also, the base 15 is a metal-made member, as shown by FIGS. 2 and 4, and is connected to the FG via a pair of metal-made coil springs 24*a* and 24*b* that are installed at two ends of the base 15. Thus, it can obtain an earth.

Moreover, the LED head with the above structure, as shown by FIG. 3, is placed to face a photo conductor drum 16. The photo conductor drum 16 is placed in an ID (image drum) unit in the image forming apparatus, which is not shown by the figures.

Further, the features 23*a* and 23*b* shown by FIG. 3, are two eccentric cam mechanisms for regulating the distance between the radiant surface (in FIG. 3: the under surface) of the SLA 12 and the surface of the photo conductor drum 16, they are respectively mounted on the bottoms at two sides of the SLA holder 14. Thus, by adjusting the eccentric cam mechanisms 23*a* and 23*b*, the distance between the radiant surface of the SLA 12 fixed on the SLA holder 14 and the surface of the photo conductor drum 16 can be regulated.

The LED head gets a spring force towards the photo conductor drum 16 (in FIG. 3: the downward direction) from the coil springs 24*a* and 24*b*. On the surface of the photo conductor drum 16, two spacers 25*a* and 25*b* are mounted. The eccentric cam mechanism 23*a* and 23*b* contact with the spacers 25*a* and 25*b*. Thus, the distance between the radiant surface of the SLA 12 and the surface of the photo conductor drum 16 is kept at a definite value, for example, $I_O$. Then, it is possible to perform the printing through using light to form an image on the surface of the photo conductor drum 16.

However, in the conventional LED head stated above, because the SLA holder 14 is a metal-made member, for obtaining an earth, as stated above, it is necessary to fix the earth line 18 on the SLA holder 14 by the metal-made screw 19. Because of this, when installing the LED head into the image forming apparatus, or removing the LED head from the image forming apparatus, a screwing process or unscrewing process becomes necessary. Thereby, the assembly efficiency and the disintegration efficiency of the LED head are lower. Further, because the earth line and the screw are necessary, the cost of the LED head is higher.

SUMMARY OF THE INVENTION

To solve the conventional problems as mentioned above, the present invention supplies an optical head with higher assembly efficiency, higher disintegration efficiency and lower cost, and an image forming apparatus using the optical head.

According to the invention, there is provided one optical head comprising:

a holder with electroconductivity which has a insulating cover and supports a light guide section;

a substrate which is mounted in the Holder and is used for installing a Emitting light section;

a base with electroconductivity used for fixing the substrate at the holder; and a clamp with electroconductivity which presses and contacts the base, wherein the clamp, while mounted onto the Holder, scrapes off contact part of the insulating cover.

In the one optical head, the clamp has a tip portion with sharp wave shape; the holder and the base are conducted electrically through the clamp; and the holder with electroconductivity is indirectly connected with a frame ground in image forming apparatus.

Further, in the optical head, the light guide section may be lens; the emitting light section may be LED; and the insulating cover may be reflection inhibition member for inhibiting the reflection of light.

According to the invention, there is provided other optical head comprising:

a holder with electroconductivity which supports a light guide section;

a substrate which is mounted in the holder and is used for installing a Emitting light section; and a base with electroconductivity used for fixing the substrate at the holder;

wherein the base presses and contacts electrically with the most basic surface of the holder.

In the other optical head, the base presses and contacts electrically with the basic surface of the holder at the positions being away from the light guide section; the base has projecting part formed at end thereof; and the holder with electroconductivity is indirectly connected with a frame ground in the image forming apparatus.

Further, in the optical head, the light guide section may be lens; and the emitting light section may be LED.

According to the invention, there is provided one image forming apparatus for forming an electrostatic latent image, comprising:

a optical head used for exposing light to a photo conductor, wherein, the optical head includes:

a Holder with electroconductivity which has a insulating cover and supports a light guide section;

a substrate which is mounted in the Holder and is used for installing a Emitting light section;

a base with electroconductivity used for fixing the substrate at the holder; and a clamp with electroconductivity which presses and contacts the base, wherein the clamp, while mounted onto the holder, scrapes off contact part of the insulating cover.

In the one image forming apparatus, the clamp has a tip portion with sharp wave shape; and the holder and the base are conducted electrically through the clamp.

According to the invention, there is provided other image forming apparatus for forming an electrostatic latent image, comprising:

a optical head used for exposing light to a photo conductor, wherein, the optical head includes:

a holder with electroconductivity which supports a light guide section;

a substrate which is mounted in the holder and is used for installing a Emitting light section; and a base with electroconductivity used for fixing the substrate at the holder;

wherein the base presses and contacts electrically with the most basic surface of the holder.

In the other image forming apparatus, the base presses and contacts electrically with the basic surface of the holder at the positions being away from the light guide section, and the base has projecting part formed at end thereof.

The above and other objects and features of the present invention will become apparent from the following detailed description and the appended claims with reference to the accompanying drawings.

DETAILED DESCRIPTION OF THE PREFERRED EMBODIMENTS

With respect to embodiments of the present invention, while referring to diagrams, the following is to explain them in detail.

<Embodiment 1>

Figure 6:
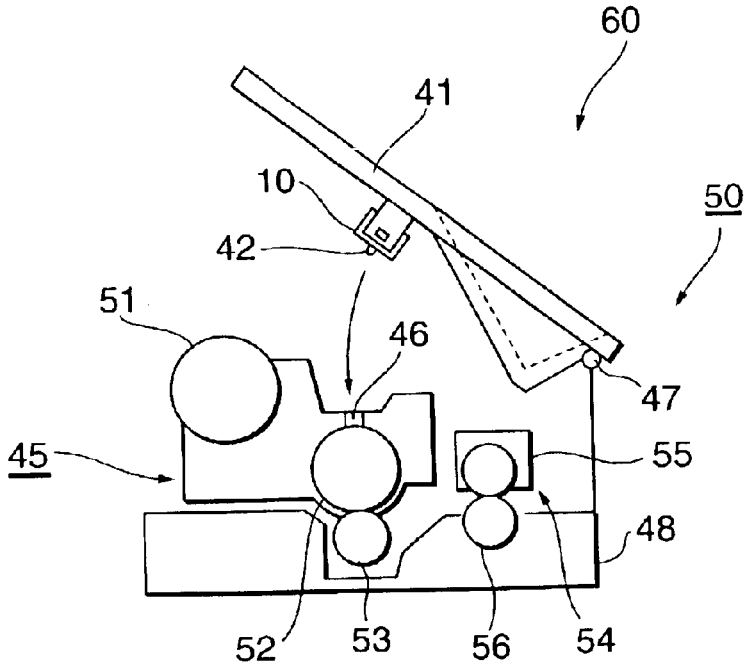
FIG. 6 is a summary diagram showing an image forming apparatus of the present invention in embodiment 1.
Figure 7:
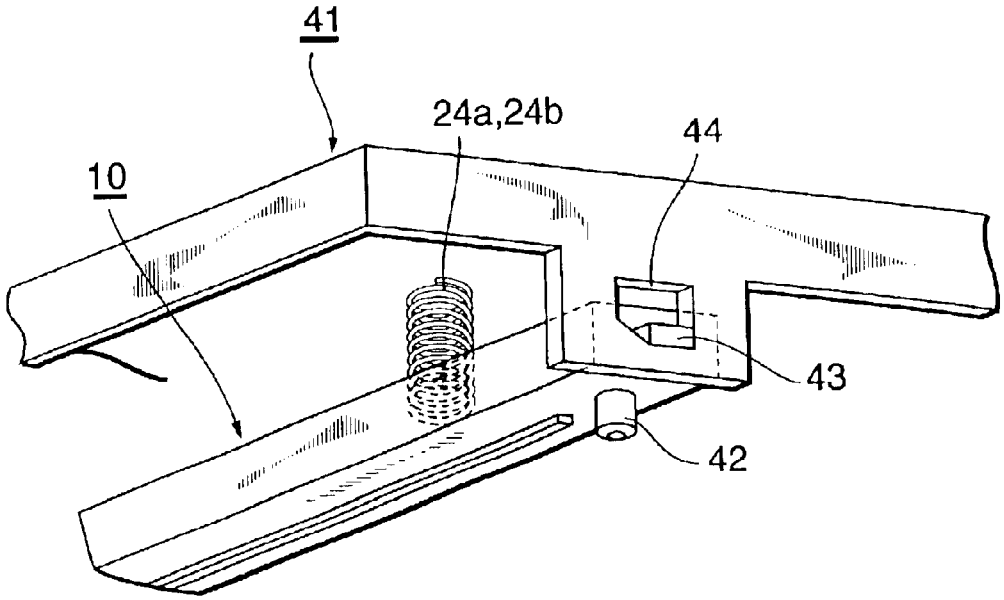
FIG. 7 is a diagram showing the supporting section of an LED head of the present invention in embodiment 1.

FIG. 6 is a summary diagram showing an image forming apparatus of the present invention in embodiment 1. FIG. 7 is a diagram showing the supporting section of an LED head of the present invention in embodiment 1. Moreover, with respect to the same composition elements as that in the conventional LED head stated above, the same symbol will be given.

The image forming apparatus 60 is an electronic photograph printer, i.e., an LED printer using an LED head 10 as a writing-in light source. In general, the LED head 10 of the LED printer, is used in an exposing process. In the exposing process, the light produced by an LED array chip is converged through an SLA, then a electrostatic latent image is formed by exposing the light on to a photo conductor drum which is placed at a position with light image-formation and is charged with electricity in its entirety.

The image forming apparatus 60, as shown by the FIG. 6, has an engine section 50. The engine section 50 comprises a toner cartridge 51 for holding toner, a photo conductor drum 52, a transfer roller 53 which is located at a position facing to the photo conductor drum 52 and is used for transferring a toner image onto a print medium shown not by the figures, and a fixing device 54 for fixing a toner image transferred on the print medium. The fixing device 54 is formed from a heating roller 55 for heating toner and a pressure roller 56 which is located at a position facing toward the heating roller 55 and is used for sandwiching, together with the heating roller 55, the print medium.

The toner cartridge 51, the photo conductor drum 52 and a developing device that is not shown in the figures form an image drum unit 45. At the upper part of the image drum unit 45, a deciding-position hole 46 used for deciding a position of the following LED head 10 is provided.

The image drum unit 45 is set in an engine chassis 48 and is pressed down by a stacker cover 41. The stacker cover 41 can revolve on a revolving fulcrum 47.

The stacker cover 41 has two holding holes 44, respectively formed at two sides of the stacker cover 41. At the reverse side of the stacker cover 41, an LED head 10 is mounted. The LED head 10 has two projective parts 43, that are formed at two sides of the LED head 10 and are put into the two holding holes 44, respectively. Thus, the LED head 10 is fixed at the reverse side of the stacker cover 41. Further, at the under part of the LED head 10, a projective fitting-part 42 used for fitting into the deciding-position hole 46 is formed.

The stacker cover 41 is opened or closed when an operation is performed, such as an exchange for the image drum unit 45, or when taking out a jammed print medium, or the like.

When the stacker cover 41 is in an open state, the image drum unit 45 indicates a fluctuation state because of a spring, that is not shown by figure. Thus, its position becomes unstable. Further, because of manufacture errors, the position of the image drum unit 45 is also unstable when the image drum unit 45 is set in the engine chassis 48. Therefore, between the projective part 43 and the holding hole 44, there is a clearance.

In the case that the stacker cover 41 is opened for the above-mentioned operations, the LED 10 may be moved from an operation area. But when closing the stacker cover 41, because the fitting part 42 enters into the deciding-position hole 46, the position of the LED head 10 is decided. Thus, the LED head 10 is correctly set on a receiving-light section, that is not shown by figures.

Next, the composition of the LED head 10 in this embodiment will be explained.

Figure 1:
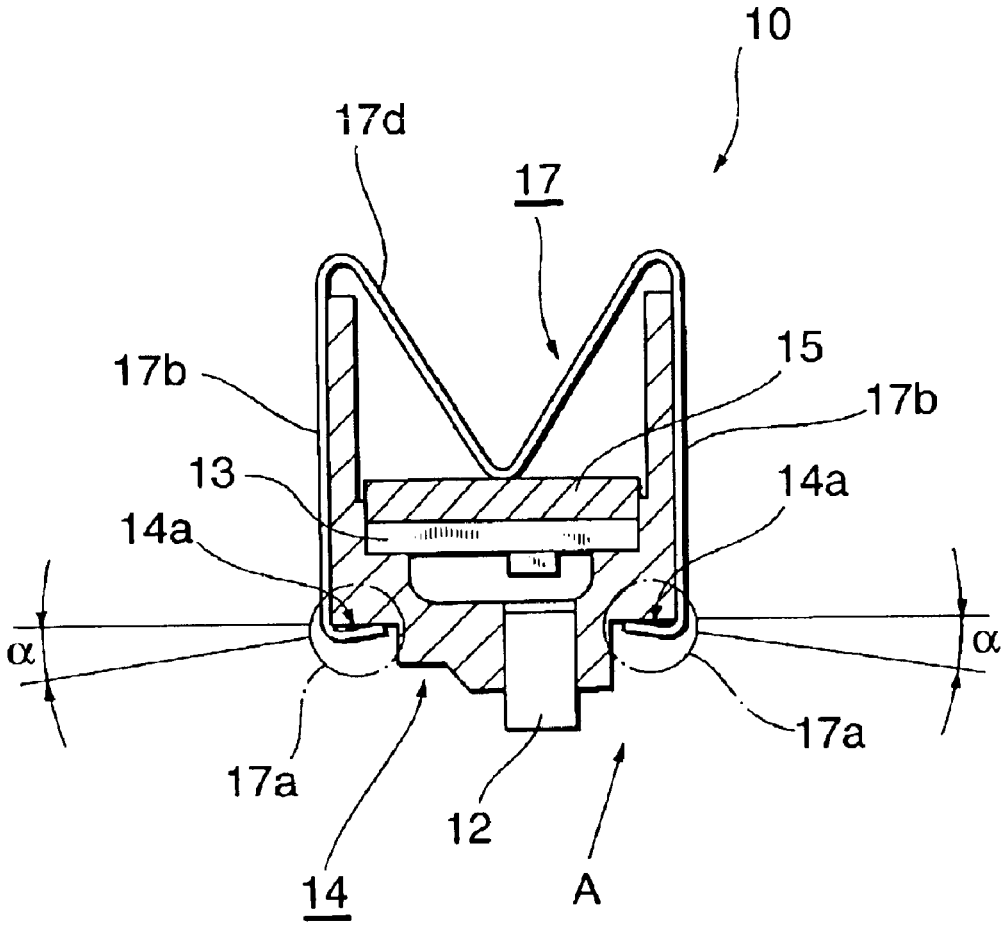
FIG. 1 is a cross-sectional view showing an LED head of the present invention in embodiment 1.
Figure 2:
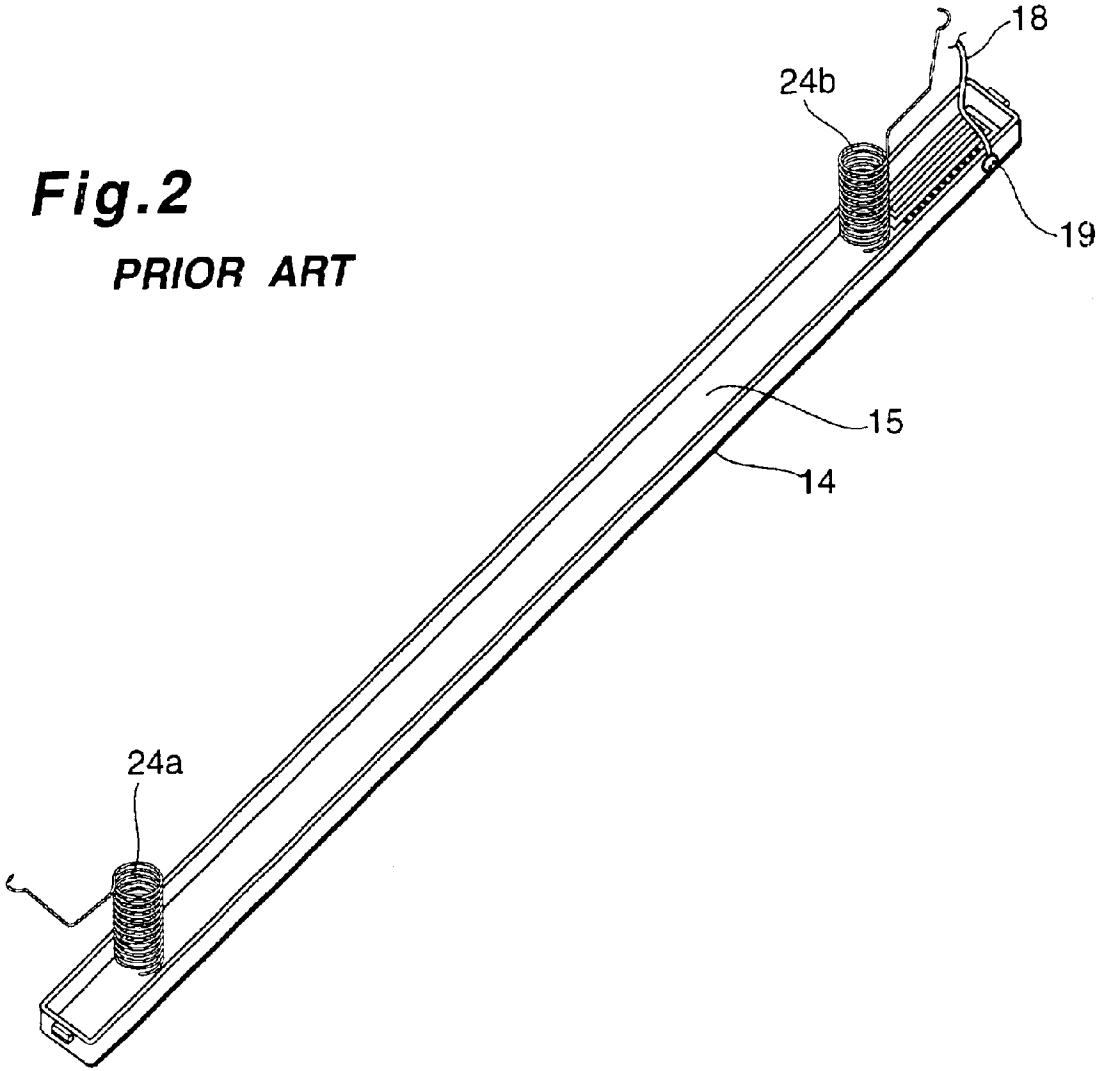
Fig.2 PRIOR ART
FIG. 2 is a perspective view showing a conventional LED head.
Figure 3:
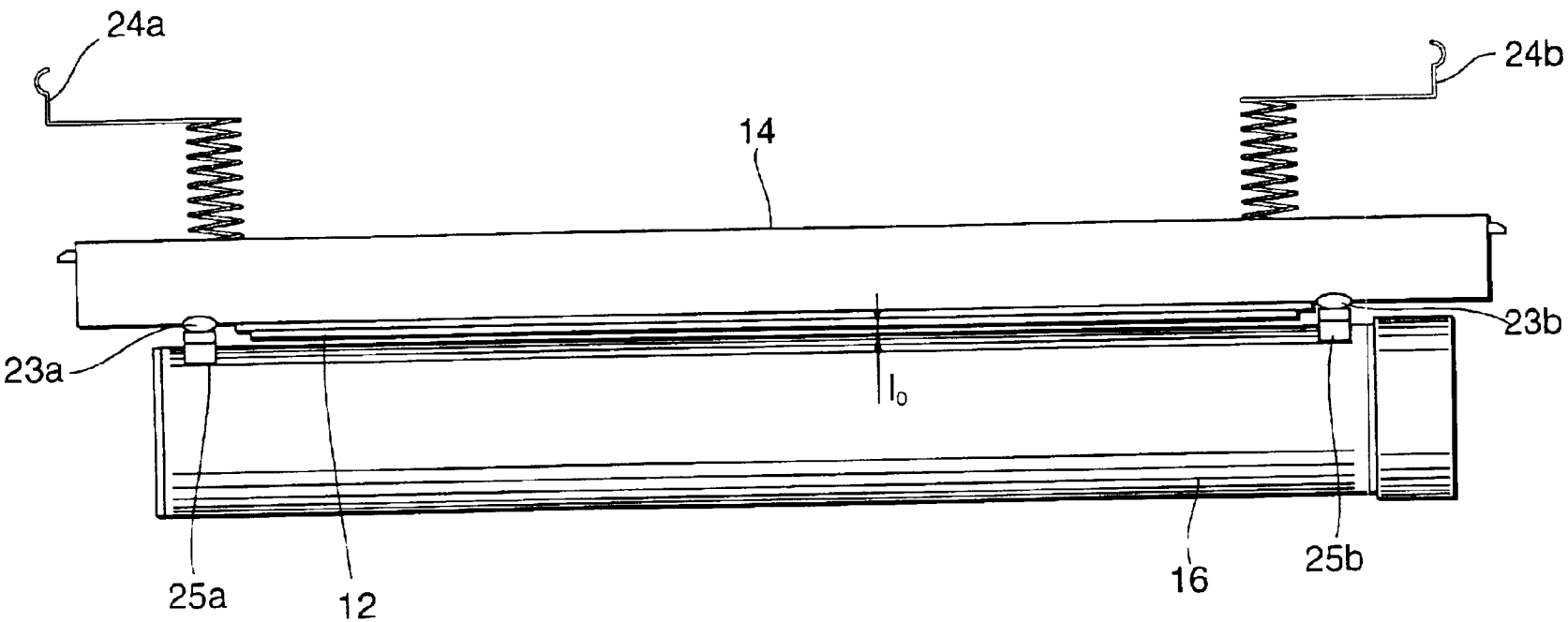
Fig.3 PRIOR ART
FIG. 3 is a front view showing the conventional LED head.
Figure 4:
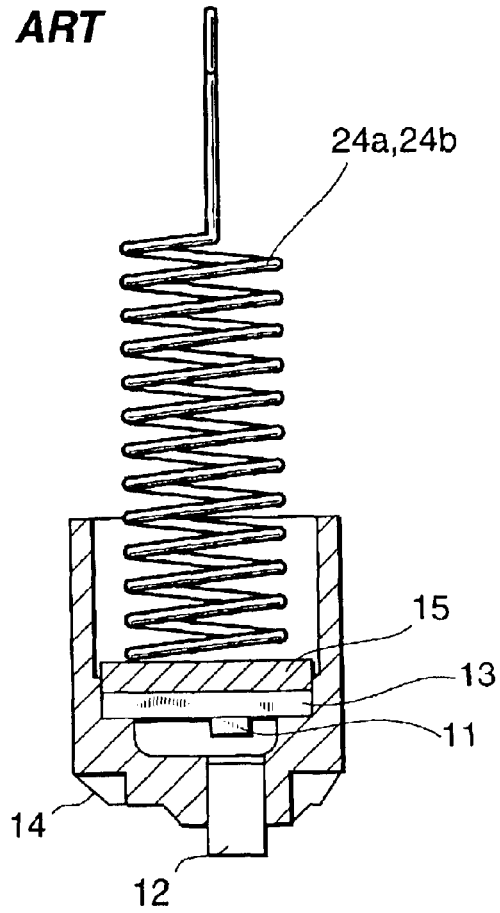
Fig.4 PRIOR ART
FIG. 4 is a first cross-sectional view showing the conventional LED head.
Figure 5:
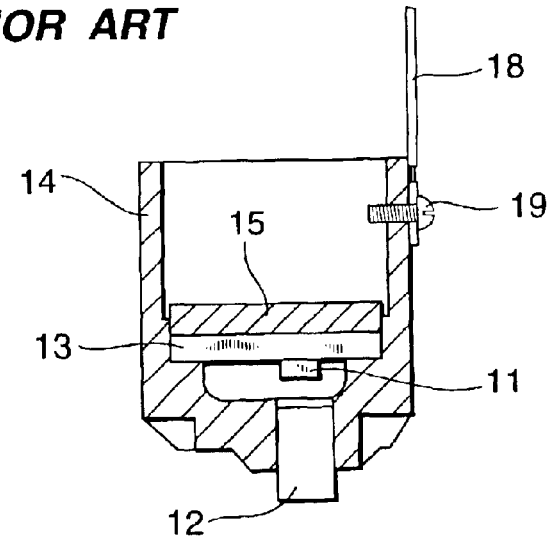
Fig.5 PRIOR ART
FIG. 5 is a second cross-sectional view showing the conventional LED.
Figure 8:
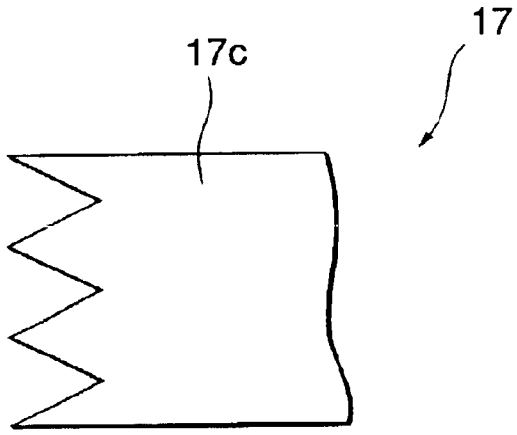
FIG. 8 is A—A cross-sectional view of FIG. 1.

FIG. 1 is a cross-sectional view showing an LED head of the present invention in embodiment 1; FIG. 8 is A—A cross-sectional view of FIG. 1.

In this embodiment, there is no need to use other material, for example, an earth line or screw, but it is possible to certainly give an earth to the SLA holder 14 by a connection with the FG of the image forming apparatus. That is, in the LED head 10 of the embodiment, a metal-made clamp 17 is used. The clamp 17, as shown by FIG. 1, has an "M"-shape, and covers and contacts with the outer surface of the SLA holder. Further, the clamp 17 contacts with the base 15. Thus, between the SLA holder 14 and the base 15, conduction can be obtained. Because the base 15 can obtain an earth through the coil spring 24*a* and 24*b* connecting with the FG of the image forming apparatus, the SLA holder 14 also can obtain a earth from the base 15 only by using the clamp 17.

In detail, the base 15 is an aluminum member with a board shape, so its surface can obtain an electric conduction. Then, the substrate 13 is pressed towards the SLA holder 14, by the clamp 17 through the base 15. Thus it is possible to certainly fix the substrate 13.

The clamp 17 has a central part 17*d* with a V-shape, two arm parts 17*b* and two ends 17*a*, respectively connecting with the arm parts 17*b*. Each end 17*a* presses the corner part with a contacting surface 14*a* of the SLA holder 14, and inclines towards the contacting surface 14*a* with an angle $\alpha$. The end 17*a*, as shown by FIG. 8, has a sharp-edged tip portion 17*c* with wave shape.

Thus, when the clamp 17 is pressed down along the outer surface of the SLA holder 14 and mounted onto the SLA holder 14, even if there is insulating material on the outer surface of the SLA holder 14, because the end 17*a* has such a tip portion 17*c*, the tip portion 17*c* scrapes off the insulating material on the outer surface of the SLA holder 14, and the clamp 17 electrically can contact with the SLA holder 14.

With respect to the LED head 10, first, after mounting the substrate 13 into the SLA holder 14, the base 15 is mounted into the SLA holder 14 for sandwiching the substrate 13. Then, the clamp 17 with an M-shape is mounted.

Next, to explain the mounting method of the clamp 17.

Figure 9:
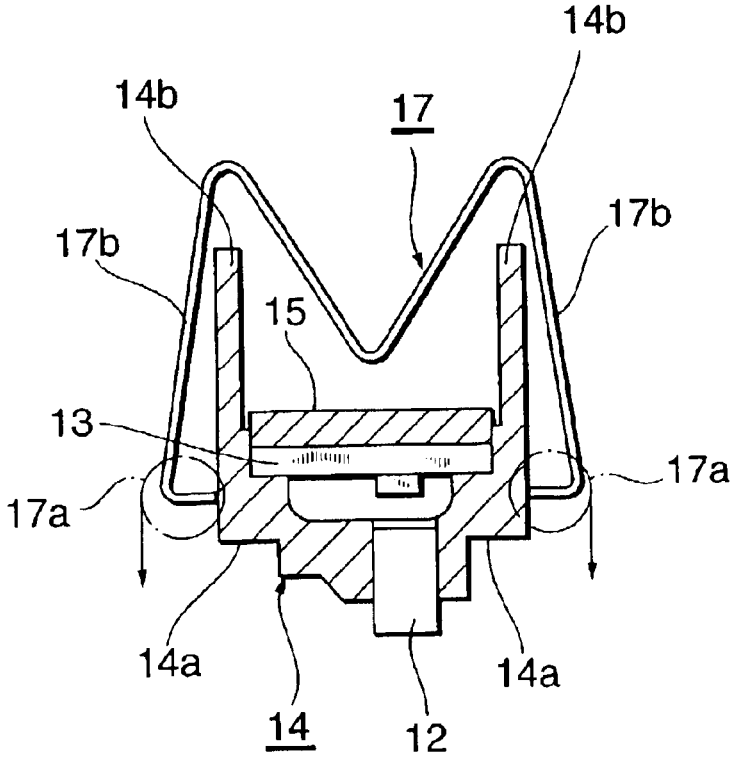
FIG. 9 is a first explanation diagram for explaining the mounting method of a clamp.
Figure 10:
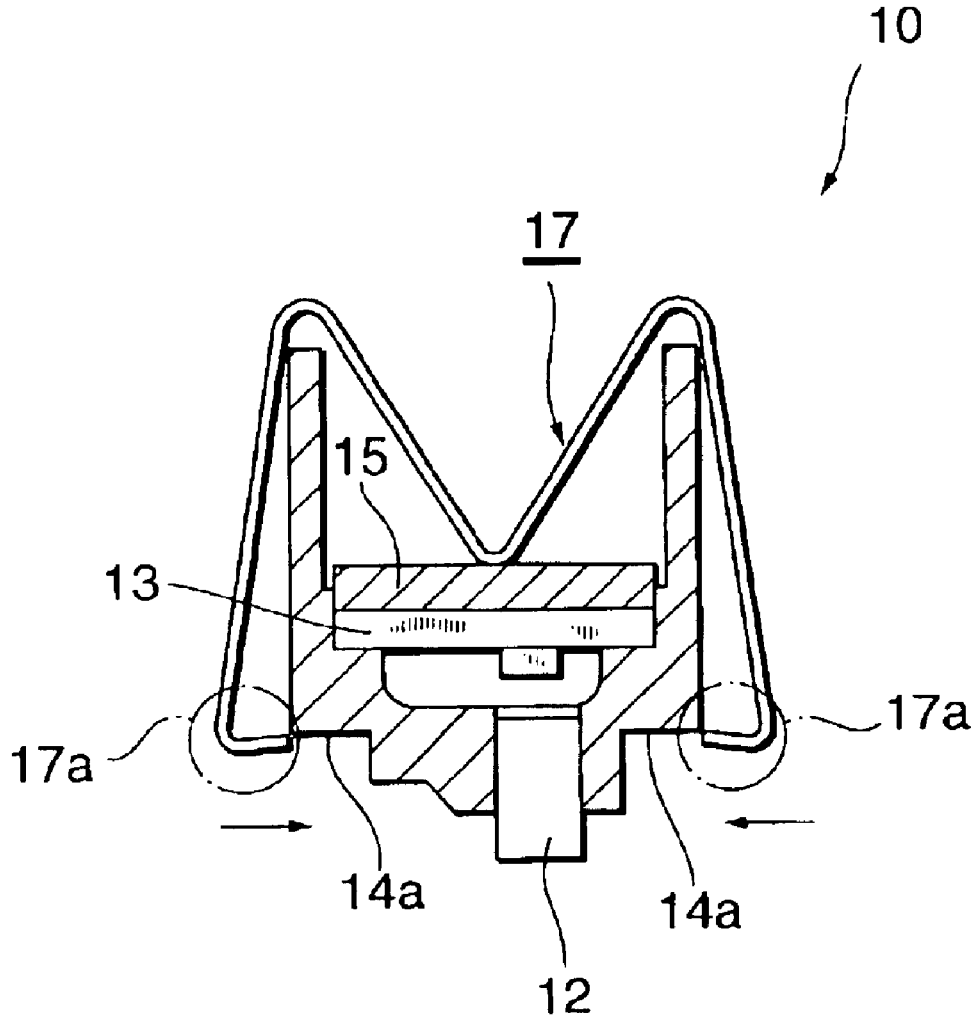
FIG. 10 is a second explanation diagram for explaining the mounting method of a clamp.

FIG. 9 is a first explanation diagram for explaining the mounting method of a clamp. FIG. 10 is a second explanation diagram for explaining the mounting method of a clamp.

In the mounting process with respect to the clamp 17, first the central part 17*d* is placed over the base 15, and the two arm parts 17*b* are respectively located at two sides of the SLA holder 14. Then, the two ends 17*a* are placed on the upper-side parts 14*b* of the outer surface of the SLA holder 14. At this time, the clamp 17 has an elastic transformation. Next, the clamp 17 is pressed down so as to make the two parts 17*b* and the two ends 17*a* move down along the outer surface of the SLA holder 14 from the upper-side parts 14*b*. Because there is the above stated tip portion 17*c* in the end parts 17*a*, the insulating material painted on the outer surface of the SLA holder 14, is scraped off by the tip portion 17*c*. On the other hand, as shown by FIGS. 9 and 10, when the end 17*a* moves down to the position corresponding to the level of the contacting surface 14*a*, because of an elasticity of the clamp 17, the end 17*a* further moves onto the contacting surface 14*a* from the outer surface of the SLA holder 14. Thus, on one hand, the aluminum member on the outer surface of the SLA holder 14 is exposed; on the other hand, the clamp 17 returns to the original M-shape from the elastic transformation. Thus, the arm part 17*b* contacts tightly with the outer surface of the SLA holder 14. Thereby, between the clamp 17 and the SLA holder 14, it is possible to obtain an electrical conduction. As a result, the SLA holder 14 connects electrically with the base 15 via the clamp 17.

Then, through the coil springs 24*a* and 24*b* on the base 15, which is connected with the above-mentioned FG of the image forming apparatus, while the base 15 gets an earth, the SLA holder 14 also can obtain an earth.

Moreover, the clamp 17 can be easily removed by only moving the ends 17*a* towards the two outer sides respectively, then moving the clamp 17 upwards.

Therefore, with respect to such an LED head 10 with the above-described composition, its number of parts, i.e. cost, can be reduced and its disintegration efficiency and its assembly efficiency can be improved.

Next, to explain an embodiment 2 of the present invention.

In the embodiment 2, with respect to the same composition elements as that in the above embodiment 1, they will be given the same symbol.

Figure 11:
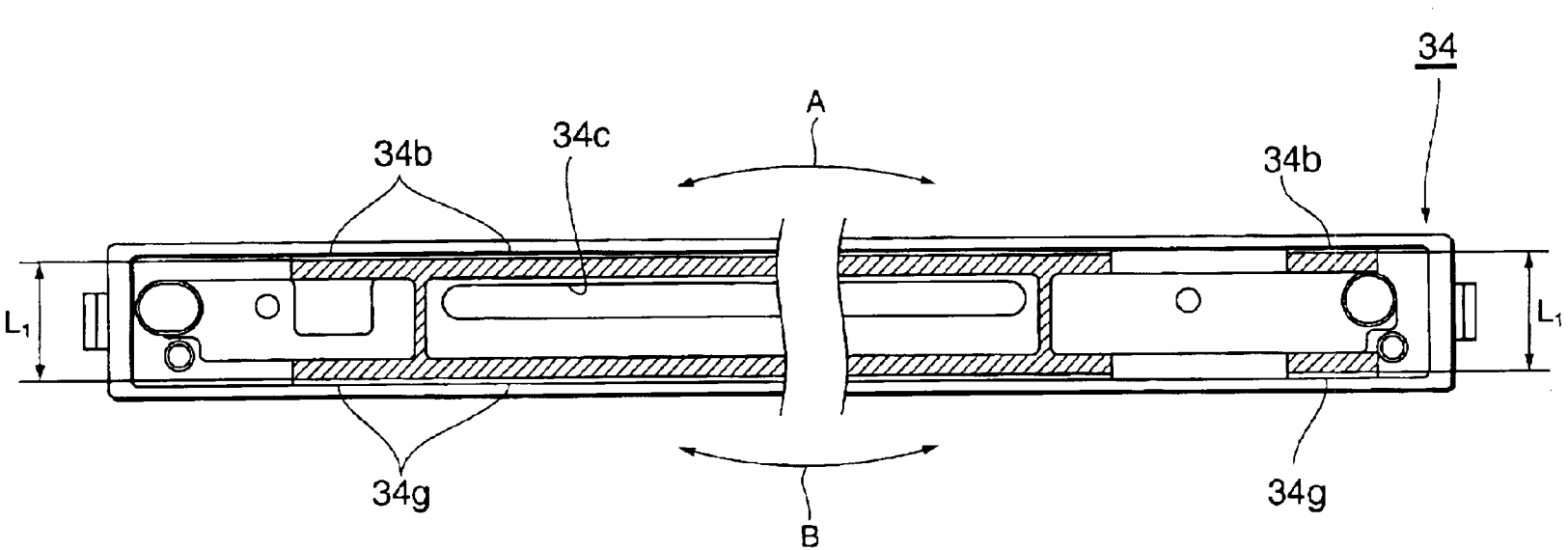
FIG. 11 is a plane view showing a SLA holder in embodiment 2 of the present invention.
Figure 12:
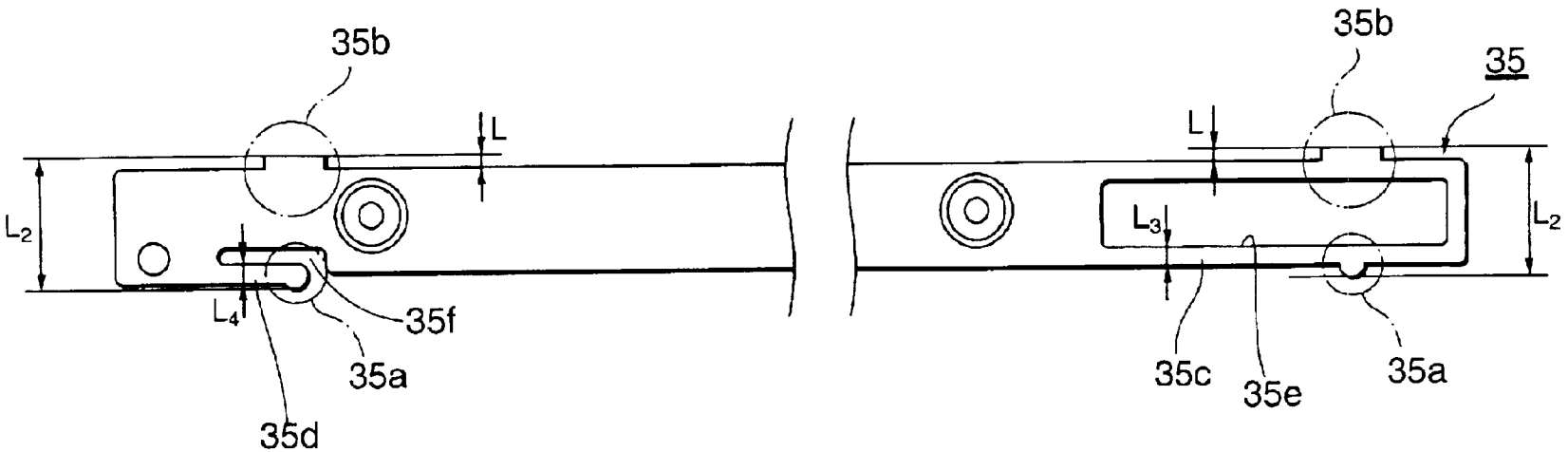
FIG. 12 is a plane view showing a base in embodiment 2 of the present invention.
Figure 13:
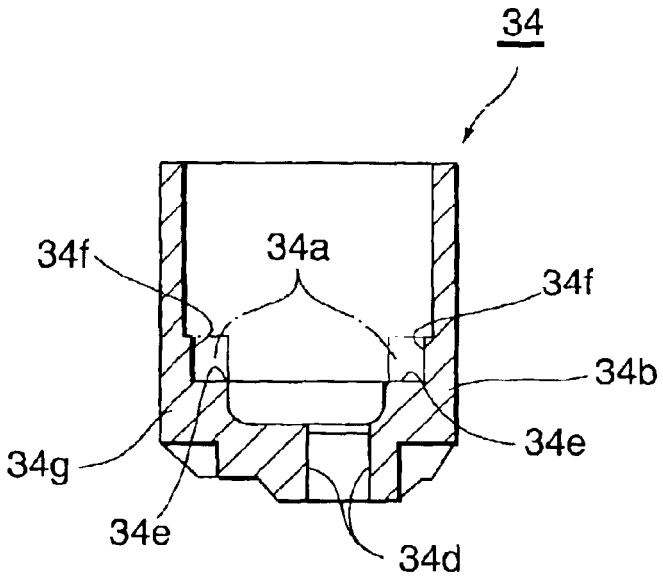
FIG. 13 is a cross-sectional view showing a SLA holder in embodiment 2 of the present invention.
Figure 14:
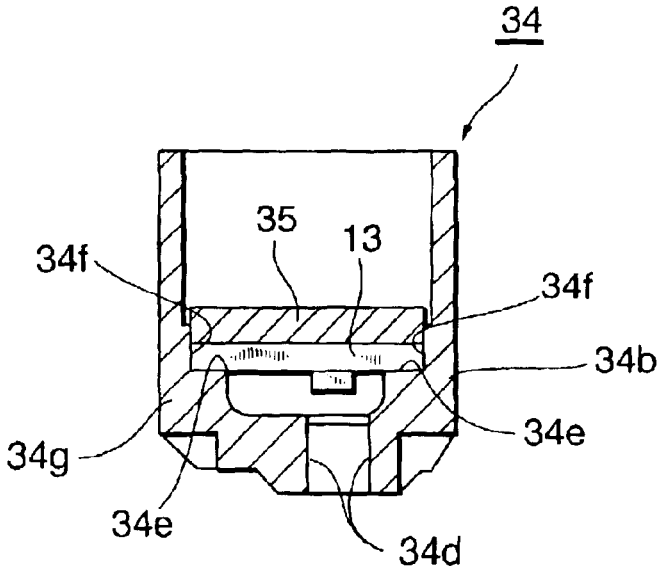
FIG. 14 is a cross-sectional view showing an LED head in embodiment 2 of the present invention.

FIG. 11 is a plane view showing a SLA holder in embodiment 2 of the present invention; FIG. 12 is a plane view showing a base in embodiment 2 of the present invention; FIG. 13 is a cross-sectional view showing a SLA holder in embodiment 2 of the present invention; and FIG. 14 is a cross-sectional view showing a LED head in embodiment 2 of the present invention.

By the way, in the embodiment 1, because the tip portion 17*c* of the clamp 17, while the clamp 17 is mounted, scrapes off the painting i.e. insulating material, the SLA holder 14 can electrically contact with the base 15 through the clamp 17. Further, since the base 15 gets an earth via the coil springs 24*a* and 24*b* that are connecting with the FG of the image forming apparatus, the SLA holder 14 can also get an earth.

However, in the embodiment 2 of the present invention, it is possible to more certainly obtain an earth with respect to a SLA holder. In this case, a SLA holder 34, after being formed by a die-casting using aluminum, is painted and covered by an insulating material on its whole surface. Here, as shown in FIG. 11, the width L1 between two facing inner surfaces may be set according to a size of 10.8 mm.

Further, with respect to the mounting surface ( be shown by a slanted line in FIG. 11 ) using as substrate-connection surface of the SLA holder 34 for substrate 13, because its accuracy is requested, it is processed by mechanical process, for example, a cutting process or the like. As shown by FIG. 13, an unnecessary part 34*a* is formed initially while performing the die-casting, then it is processed by the mechanical process. Thus, two mounting surfaces 34*f* and 34*e* are formed and have no paint respectively. So the mounting surfaces 34*f* and 34*e* all show the natural aluminum ground so that they have an electroconductivity.

In the embodiment 2, a base 35 used for sandwiching the substrate 13 together with the SLA holder 34, is formed by blanking using a aluminium substrate with a thickness of 1.5 mm. Further, at the two facing sides, respectively, two projecting parts (contacting portions) 35*a* and 35*b* are formed.

Thus, as shown by FIG. 12, at the side of the projecting part 35*a*, as the shape of the projecting part 35*a*, there is elasticity; at the side of the projecting 35*b*, the projecting part 35*b* projects over the outer surface with a width L. In this case, the width L2 at the position of these projecting parts may be set according to a size of about 11.33 mm, and is broader by about 0.53 mm than the inside width L1 of the SLA holder 34. Moreover, if setting the L for the projecting part 35*b* at 0.1 mm, the projecting part 35*a* needs to project over the outer surface by 0.43 mm.

Thereby, by making the belt-shape section 35*c* and 35*d* respectively containing projecting part 35*a* elastically transform, and pressing the base 35 into the SLA holder 34, the base 35 is mounted certainly into the SLA holder 34, and contacts certainly with its mounting surfaces 34*f* and 34*e*. Thus, it is possible to obtain an electrical conduction between the base 35 and the SLA holder 34.

In the SLA holder 34, a hole 34*c* used for mounting the SLA 12 is formed. Because of this, the strength of side-walls 34*b* and 34*g* of the SLA holder 34 becomes small. By the way, if forming the projecting parts 35*a* and 35*b* at the positions near the hole 34*c*, when mounting the base 35 into the SLA holder 34, the side-walls 34*b* and 34*g* will respectively transform as shown by the arrows A and B in FIG. 11. During this, the installation surface 34*d*, 34*d* shown by FIGS. 13 and 14 for the SLA 12 will also transform. Further, because the hole 34*c* is more near the side wall 34*b*, the mounted SLA 12 will transform in the direction of the arrow A. Thus, the amount of light towards the photo conductor drum 16 will become uneven, so that, it will bring a bad influence for printing.

However, in the embodiment 2, the projecting parts 35*a* or 35*b* is formed at the position within 5 cm from the end on the length direction of the base 35, that is, is formed the position near the end of the base 35. Thus, because the central part of the side wall 34*b* or 34*g* near the hole 34*c* has no transformation, the installation surface 34*d*, 34*d* for the SLA 12 will not transform. Therefore, it is possible to get a uniform amount of light.

Moreover, in the base 35, as shown by FIG. 12, a hole 35*e* and a cut 35*f* are formed, thus, the belt-shape sections 35*c* and 35*d* respectively containing the projecting part 35*a* are also formed. Therefore, the belt-shape sections 35*c* and 35*d* respectively have elasticity at the width direction of the base 35, and the width L3 of the belt-shape section 35*c* may be set according to a size of 1.55 mm, and the width L4 of the belt-shape section 35*d* may be set according to a size of 1.75 mm. By using such belt-shape sections 35*c* and 35*d*, it is possible to prevent the transformation of the SLA holder 34.

Moreover, in the embodiment, the one projecting part 35*a* to contact with the side wall 34*g* of the SLA holder 34 is formed with an arc-shape portion for reduce the friction load caused while assembling the base 35 into the SLA holder 34; the other projecting part 35*b* is long formed for finely electrically contacting with the side wall 34*b* of the SLA holder 34. Further, the one and the other projecting parts 35*a* and 35*b* are respectively formed at the different sides of the base 35. Then, the one pair of the one and the other projecting parts 35*a* and 35*b* is placed at one end in the length direction, and the other pair of the one and the other projecting parts 35*a* and 35*b* is placed at other end in the length direction.

As stated above, the base 35 electrically contacts with the SLA holder 34. Further, the base gets an earth via the coil springs 24*a* and 24*b* connecting with FG of the image forming apparatus. Therefore, the SLA holder 34 can easily get an earth.

In this embodiment 2, as in the embodiment 1, even if not using these, for example, the earth line 18 and the screw 19, the SLA holder 34 can easily get an earth. Therefore, with respect to such an LED head with the above-described composition, its parts number, i.e., cost can also be reduced and its disintegration efficiency and its assembly efficiency can also be improved.

In the present invention, as stated above, serving as an optical head, it comprises a SLA holder with electroconductivity which has a insulating cover and supports a rod lens array with convergency; a substrate which is mounted in the SLA holder and is used for installing a LED array chip; a base with electroconductivity used for fixing the substrate at the SL holder; and a clamp with electroconductivity which presses and contacts the base, wherein the clamp, while mounted onto the SLA holder, scrapes off contact part of the insulating cover.

Therefore, the base electrically contacts with the SLA holder, then the SLA holder 34 can easily get an earth. Thus, with respect to such LED head, its parts number i.e. cost can also be reduced and its disintegration efficiency and its assembly efficiency can also be improved.

The present invention is not limited to the foregoing embodiments but many modifications and variations are possible within the spirit and scope of the appended claims of the invention.

What is claimed is:

1. An optical head, comprising:

a holder comprised of an electroconductive material that is covered with an insulating material, said holder supporting a light guide section, said holder having a contacting surface;

a substrate which is mounted in said holder and has an emitting light section installed thereon;

an electroconductive base that fixes said substrate in said holder; and an electroconductive clamp which electroconductively-contacts said holder and said base, and which includes tip portions that electroconductively engage the electroconductive material at the contacting surface.

2. The optical head according to claim 1, wherein said tip portions have a sharp wave shape.

3. The optical head according to claim 1, wherein said holder and said base are electrically coupled through said clamp.

4. The optical head according to claim 1, wherein said light guide section is a lens.

5. The optical head according to claim 1, wherein said emitting light section is an LED.

6. The optical head according to claim 1, wherein said holder is indirectly electrically connected with a frame ground in an image forming apparatus.

7. The optical head according to claim 1, wherein said insulating material is a reflection inhibition material that insulates and inhibits the reflection of light.

8. The optical head according to claim 1, wherein said clamp has a end portion that includes the tip portion, the end portion having a facing surface that slantingly faces towards the contacting surface.

9. The optical head according to claim 8, wherein said clamp has a bent portion that causes the tip portion to be urged toward the contacting surface to ensure electroconductively engagement therewith.

10. The optical head according to claim 1, wherein each of the tip portions has a sharp end which is in contact with said holder.

11. An optical head, comprising:

a holder having an electroconductive contacting planar surface, and supporting a light guide section, and having an insulating cover;

a substrate which is mounted in said holder and has an emitting light section thereon; and an electroconductive base that fixes said substrate in said holder, said base including a first contacting portion that directly electroconductively contacts the contacting planar surface of said holder;

wherein the first contacting portion of said base includes an elastic part that engages with said holder.

12. The optical head according to claim 11, wherein said first contacting portion of said base is located at a position away from longitudinally disposed ends of said light guide section.

13. The optical head according to claim 11, wherein said base has a second contacting portion having a shape that is different from a shape of the first contacting portion.

14. The optical head according to claim 13, wherein said first and second contacting portions are formed on opposite sides of said base.

15. The optical head according to claim 11, wherein said light guide section is a lens.

16. The optical head according to claim 11, wherein said emitting light section is an LED.

17. The optical head according to claim 11, wherein said holder is indirectly electrically connected with a frame ground in an image forming apparatus.

18. The optical head according to claim 11, wherein said base includes a plurality of contacting portions, which include said first contacting portion, each of which presses against, and electroconductively contacts, the contacting planar surface of said holder.

19. An image forming apparatus for forming an electrostatic latent image, comprising:

a optical head used for exposing a photoconductor to light, including:

a holder comprised of an electroconductive material that is covered with an insulating material, said holder supporting a light guide section, said holder having a contacting surface;

a substrate which is mounted in said holder and has an emitting light section installed thereon;

an electroconductive base that fixes said substrate in said holder; and an electroconductive clamp which electroconductively-contacts said holder and said base, and which includes tip portions that electroconductively engages the electroconductive material at the contacting surface.

20. The image forming apparatus according to claim 19, wherein said tip portions have a sharp wave shape.

21. The image forming apparatus according to claim 19, wherein said holder and said base are electrically coupled through said clamp.

22. An image forming apparatus for forming an electrostatic latent image, comprising:

a optical head used for exposing a photoconductor to light, including:

a holder having an electroconductive contacting planar surface, and supporting a light guide section, and having an insulating cover;

a substrate which is mounted in said holder and has an emitting light section thereon; and an electroconductive base that fixes said substrate in said holder, said base including a first contacting portion that directly electroconductively contacts the contacting planar surface of said holder;

wherein the first contacting portion of said base includes an elastic part that engages with said holder.

23. The image forming apparatus according to claim 22, wherein said first contacting portion of said base is located at a position away from longitudinally disposed ends of said light guide section.

24. An array head having an emitting light section with an array shape, comprising:

a holder comprised of an electroconductive material that is covered with an insulating material, said holder supporting a light guide section, said holder having a contacting surface;

a substrate having the emitting light section with an array shape thereon;

a electroconductive base for fixing the substrate to the holder; and an electroconductive clamp which electroconductively-contacts said holder and said base, and which includes tip portions that electroconductively engage the electroconductive material at the contacting surface.

25. The array head according to claim 24, wherein said tip portions have a sharp wave shape.

26. The array head according to claim 24, wherein said holder and said base are electrically coupled through said clamp.

27. The array head according to claim 24, wherein said light guide section is a lens.

28. The array head according to claim 24, wherein said emitting light section is an LED.

29. The array head according to claim 24, wherein said holder is indirectly electrically connected with a frame ground in an image forming apparatus.

30. The array head according to claim 24, wherein said insulating material is a reflection inhibition material that insulates and inhibits the reflection of light.

31. An array head having an emitting light section with an array shape, comprising:

a holder comprised of an electroconductive material that is covered with an insulating material, said holder having an electroconductive contacting planar surface that is not covered by the insulating material, said holder supporting a light guide section;

a substrate having the emitting light section with an array shape thereon; and an electroconductive base that fixes the substrate to the holder, said base including a first contacting portion that directly electroconductively contacts the contacting planar surface of said holder;

wherein the first contacting portion of said base includes an elastic part that engages with said holder.

32. The array head according to claim 31, wherein said first contacting portion of said base is located at a position away from longitudinally disposed ends of said light guide section.

33. The array head according to claim 31, wherein said base has a second contacting portion having a shape that is different from a shape of the first contacting portion.

34. The array head according to claim 33, wherein said first and second contacting portions are formed on opposite sides of said base.

35. The array head according to claim 31, wherein said light guide section is a lens.

36. The array head according to claim 31, wherein said emitting light section is an LED.

37. The array head according to claim 31, wherein said holder is indirectly electrically connected with a frame ground in an image forming apparatus.

38. An image forming apparatus for forming an electrostatic latent image, comprising:

an array head having an emitting light section with an array shape, and being used for exposing a photoconductor to light, including:

a holder comprised of an electroconductive material that is covered with an insulating material, said holder supporting a light guide section, said holder having a contacting surface;

a substrate having the emitting light section with an array shape thereon;

a electroconductive base for fixing the substrate to the holder; and an electroconductive clamp which electroconductively-contacts said holder and said base, and which includes tip portions that electroconductively engage the electroconductive material at the contacting surface.

39. The image forming apparatus according to claim 38, wherein said tip portions have a sharp wave shape.

40. The image forming apparatus according to claim 38, wherein said holder and said base are conducted electrically through said clamp.

41. An image forming apparatus for forming an electrostatic latent image, comprising:

an array head having an emitting light section with an array shape, and being used for exposing a photoconductor to light, including:

a holder comprised of an electroconductive material that is covered with an insulating material, said holder having an electroconductive contacting planar surface that is not covered by the insulating material, said holder supporting a light guide section;

a substrate having the emitting light section with an array shape thereon; and an electroconductive base that fixes the substrate to the holder, said base including a first contacting portion that directly electroconductively contacts the contacting planar surface of said holder;

wherein the first contacting portion of said base includes an elastic part that engages with said holder.

42. The image forming apparatus according to claim 41, wherein said first contacting portion of said base is located at a position away from longitudinally disposed ends of said light guide section.

* * * * *